US010851438B2

(12) United States Patent
Huang et al.

(10) Patent No.: US 10,851,438 B2
(45) Date of Patent: Dec. 1, 2020

(54) OXIDE DISPERSION-STRENGTHENED ALLOY (ODS), LEAD-FREE AND FREE-CUTTING BRASS AND PRODUCING METHOD THEREOF

(71) Applicant: HUNAN TERRY NEW MATERIALS COMPANY LTD., Hunan (CN)

(72) Inventors: Jinsong Huang, Hunan (CN); Xin Jin, Hunan (CN); Wei Li, Hunan (CN); Bin Liu, Hunan (CN); Zhongling Zhang, Hunan (CN); Shun Li, Hunan (CN); Ziyang Gan, Hunan (CN)

(73) Assignee: Hunan Terry New Materials Company Ltd., Hunan (CN)

( * ) Notice: Subject to any disclaimer, the term of this patent is extended or adjusted under 35 U.S.C. 154(b) by 224 days.

(21) Appl. No.: 16/060,914

(22) PCT Filed: Dec. 10, 2015

(86) PCT No.: PCT/CN2015/096925

§ 371 (c)(1),
(2) Date: Jun. 8, 2018

(87) PCT Pub. No.: WO2017/096572

PCT Pub. Date: Jun. 15, 2017

(65) Prior Publication Data

US 2018/0355459 A1 Dec. 13, 2018

(51) Int. Cl.
*C22C 9/04* (2006.01)
*C22C 1/10* (2006.01)
(Continued)

(52) U.S. Cl.
CPC ..... *C22C 9/04* (2013.01); *B22F 3/16* (2013.01); *C22C 1/0425* (2013.01);
(Continued)

(58) Field of Classification Search
CPC ..... C22C 9/04; C22C 1/0425; C22C 1/1084; B22F 3/16
See application file for complete search history.

(56) References Cited

U.S. PATENT DOCUMENTS 5,089,354 A 2/1992 Nakashima et al.

FOREIGN PATENT DOCUMENTS

CN 1546703 A 11/2004
CN 101623759 A 1/2010
(Continued)

*Primary Examiner* — Jessee R Roe
(74) *Attorney, Agent, or Firm* — Mauriel Kapouytian Woods LLP; Michael Mauriel

(57) ABSTRACT

Oxide dispersion-strengthened alloy (ODS), lead-free and free-cutting brass and producing method thereof. The mass percent of components in the brass are: 52.0%-90.0% of copper, 0.001%-0.99% of phosphorus, 0.15%-0.70% of tin, 0.25%-3.0% of manganese, 0.15%-0.90% of aluminum, 0.10%-1.5% of nickel, 0.191%-0.90% of oxygen, and 0.06%-0.80% of carbon, the ratio of aluminum to oxygen not exceeding 27:24, with the balance being zinc and inevitable impurities, wherein lead is not more than 0.08%. The brass is produced by a powder metallurgy method: brass powder, copper oxide powder, and graphite micro powder are mixed evenly; 0.001%-1.5% of a forming agent is added and mixed evenly with the mixture; and then molded by compression, and sintering are performed before post-treatment.

8 Claims, 8 Drawing Sheets

| Embodiments | Cu/ % | Al/ % | Mn/ % | P/ % | Sn/ % | Zn/ % |
|---|---|---|---|---|---|---|
| 1 | 56.0 | 0.19 | 0.50 | 0.11 | 0.20 | Balance |
| 2 | 56.0 | 0.20 | 0.60 | 0.12 | 0.30 | Balance |
| 3 | 56.0 | 0.19 | 0.50 | 0.13 | 0.20 | Balance |
| 4 | 56.0 | 0.19 | 0.50 | 0.09 | 0.55 | Balance |
| 5 | 57.0 | 0.20 | 0.70 | 0.12 | 0.30 | Balance |
| 6 | 56.0 | 0.20 | 0.60 | 0.08 | 0.25 | Balance |
| 7 | 56.0 | 0.15 | 0.35 | 0.16 | 0.017 | Balance |
| 8 | 56.0 | 0.15 | 0.35 | 0.10 | 0.15 | Balance |
| 9 | 56.0 | 0.19 | 0.50 | 0.15 | 0.50 | Balance |
| 10 | 56.0 | 0.20 | 0.60 | 0.12 | 0.50 | Balance |
| 11 | 56.0 | 0.19 | 0.50 | 0.11 | 0.20 | Balance |
| 12 | 56.0 | 0.19 | 0.50 | 0.09 | 0.50 | Balance |
| 13 | 56.0 | 0.19 | 0.50 | 0.15 | 0.55 | Balance |
| 14 | 56.0 | 0.19 | 0.50 | 0.12 | 0.55 | Balance |
| 15 | 56.0 | 0.17 | 0.40 | 0.14 | 0.60 | Balance |
| 16 | 56.0 | 0.16 | 0.40 | 0.12 | 0.15 | Balance |
| 17 | 63.0 | 0.40 | 0.80 | 0.05 | 0.25 | Balance |
| 18 | 69.0 | 0.16 | 0.40 | 0.05 | 0.60 | Balance |
| 19 | 69.0 | 0.20 | 0.60 | 0.05 | 0.50 | Balance |
| 20 | 69.0 | 0.80 | 0.30 | 0.05 | 0.15 | Balance |
| 21 | 69.0 | 0.18 | 0.40 | 0.05 | 0.55 | Balance |
| 22 | 69.0 | 0.20 | 0.60 | 0.05 | 0.25 | Balance |
| 23 | 69.0 | 0.16 | 0.40 | 0.05 | 0.60 | Balance |
| 24 | 54.0 | 1.0 | 1.0 | 0.05 | 0.15 | Balance |
| 25 | 69.0 | 0.25 | 0.60 | 0.05 | 0.25 | Balance |
| 26 | 69.0 | 0.19 | 0.50 | 0.05 | 0.20 | Balance |
| 27 | 68.0 | 0.30 | 0.70 | 0.05 | 0.30 | Balance |
| 28 | 70.0 | 2.0 | 3.0 | 0.99 | 0.70 | Balance |
| 29 | 54.0 | 1.5 | 2.0 | 0.89 | 0.70 | Balance |
| 30 | 70.0 | 1.0 | 0.65 | 0.05 | 0.70 | Balance |
| 31 | 80.0 | 1.5 | 1.5 | 0.69 | 0.70 | Balance |
| 32 | 88.0 | 2.0 | 1.0 | 0.29 | 0.70 | Balance |
| 33 | 60.0 | 0.50 | 0.80 | 0.03 | 0.30 | Balance |

(51) Int. Cl.

| | |
|---|---|
| ***B22F 3/16*** | (2006.01) |
| ***C22C 1/04*** | (2006.01) |
| *B22F 3/24* | (2006.01) |
| *C22C 32/00* | (2006.01) |

(52) U.S. Cl.
CPC ..... *C22C 1/1084* (2013.01); *B22F 3/24* (2013.01); *B22F 2998/10* (2013.01); *B22F 2999/00* (2013.01); *C22C 32/0021* (2013.01); *C22C 32/0084* (2013.01)

(56) References Cited

FOREIGN PATENT DOCUMENTS

| | | | |
|---|---|---|---|
| CN | 102634688 | A | 8/2012 |
| WO | 2012096237 | A1 | 7/2012 |

| Embodiments | Cu/ % | Al/ % | Mn/ % | P/ % | Sn/ % | Zn/ % |
|---|---|---|---|---|---|---|
| 1 | 56.0 | 0.19 | 0.50 | 0.11 | 0.20 | Balance |
| 2 | 56.0 | 0.20 | 0.60 | 0.12 | 0.30 | Balance |
| 3 | 56.0 | 0.19 | 0.50 | 0.13 | 0.20 | Balance |
| 4 | 56.0 | 0.19 | 0.50 | 0.09 | 0.55 | Balance |
| 5 | 57.0 | 0.20 | 0.70 | 0.12 | 0.30 | Balance |
| 6 | 56.0 | 0.20 | 0.60 | 0.08 | 0.25 | Balance |
| 7 | 56.0 | 0.15 | 0.35 | 0.16 | 0.017 | Balance |
| 8 | 56.0 | 0.15 | 0.35 | 0.10 | 0.15 | Balance |
| 9 | 56.0 | 0.19 | 0.50 | 0.15 | 0.50 | Balance |
| 10 | 56.0 | 0.20 | 0.60 | 0.12 | 0.50 | Balance |
| 11 | 56.0 | 0.19 | 0.50 | 0.11 | 0.20 | Balance |
| 12 | 56.0 | 0.19 | 0.50 | 0.09 | 0.50 | Balance |
| 13 | 56.0 | 0.19 | 0.50 | 0.15 | 0.55 | Balance |
| 14 | 56.0 | 0.19 | 0.50 | 0.12 | 0.55 | Balance |
| 15 | 56.0 | 0.17 | 0.40 | 0.14 | 0.60 | Balance |
| 16 | 56.0 | 0.16 | 0.40 | 0.12 | 0.15 | Balance |
| 17 | 63.0 | 0.40 | 0.80 | 0.05 | 0.25 | Balance |
| 18 | 69.0 | 0.16 | 0.40 | 0.05 | 0.60 | Balance |
| 19 | 69.0 | 0.20 | 0.60 | 0.05 | 0.50 | Balance |
| 20 | 69.0 | 0.80 | 0.30 | 0.05 | 0.15 | Balance |
| 21 | 69.0 | 0.18 | 0.40 | 0.05 | 0.55 | Balance |
| 22 | 69.0 | 0.20 | 0.60 | 0.05 | 0.25 | Balance |
| 23 | 69.0 | 0.16 | 0.40 | 0.05 | 0.60 | Balance |
| 24 | 54.0 | 1.0 | 1.0 | 0.05 | 0.15 | Balance |
| 25 | 69.0 | 0.25 | 0.60 | 0.05 | 0.25 | Balance |
| 26 | 69.0 | 0.19 | 0.50 | 0.05 | 0.20 | Balance |
| 27 | 68.0 | 0.30 | 0.70 | 0.05 | 0.30 | Balance |
| 28 | 70.0 | 2.0 | 3.0 | 0.99 | 0.70 | Balance |
| 29 | 54.0 | 1.5 | 2.0 | 0.89 | 0.70 | Balance |
| 30 | 70.0 | 1.0 | 0.65 | 0.05 | 0.70 | Balance |
| 31 | 80.0 | 1.5 | 1.5 | 0.69 | 0.70 | Balance |
| 32 | 88.0 | 2.0 | 1.0 | 0.29 | 0.70 | Balance |
| 33 | 60.0 | 0.50 | 0.80 | 0.03 | 0.30 | Balance |

Fig. 1

| Embodiments | Graphite micro powder / % | Nickel powder / % | Added forming agent/ % | Oxygen in brass powder/ % | Copper oxide powder % | Brass powder / % |
|---|---|---|---|---|---|---|
| 1 | 0.10 | 0.13 | 0.5(lithium stearate) | 0.18 | 0.10 | Balance |
| 2 | 0.06 | 0.15 | 1.5(sodium stearate) | 0.18 | 0.15 | Balance |
| 3 | 0.10 | 0.13 | 0.8(magnesium stearate) | 0.19 | 0.10 | Balance |
| 4 | 0.10 | 0.13 | 1.0(aluminum stearate) | 0.20 | 0.10 | Balance |
| 5 | 0.30 | 0.5 | 0.6(potassium stearate) | 0.21 | 0.10 | Balance |
| 6 | 0.15 | 0.5 | 1.0(calcium Stearate) | 0.21 | 0.10 | Balance |
| 7 | 0.07 | 0.11 | 1.2 | 0.18 | 0.10 | Balance |
| 8 | 0.07 | 0.11 | 0.9 | 0.20 | 0.05 | Balance |
| 9 | 0.10 | 0.13 | 1.2 | 0.17 | 0.15 | Balance |
| 10 | 0.15 | 0.14 | 1.2 | 0.15 | 0.35 | Balance |
| 11 | 0.10 | 0.13 | 0.8 | 0.15 | 0.25 | Balance |
| 12 | 0.10 | 0.13 | 1.2 | 0.18 | 0.10 | Balance |
| 13 | 0.10 | 0.13 | 1.0 | 0.17 | 0.15 | Balance |
| 14 | 0.08 | 0.12 | 1.2 | 0.16 | 0.20 | Balance |
| 15 | 1.0 | 1.0 | 1.1 | 0.16 | 0.20 | Balance |
| 16 | 0.07 | 0.11 | 1.2(zinc Stearate) | 0.18 | 0.10 | Balance |
| 17 | 0.20 | 0.20 | 0.5(zinc Stearate) | 0.28 | 0.40 | Balance |
| 18 | 0.07 | 0.11 | 1.5 | 0.18 | 0.10 | Balance |
| 19 | 0.16 | 0.14 | 0.8 | 0.20 | 0.10 | Balance |
| 20 | 0.07 | 0.11 | 1.0 | 0.40 | 1.60 | Balance |
| 21 | 1.0 | 1.0 | 0.6 | 0.19 | 0.05 | Balance |
| 22 | 0.15 | 0.14 | 1.0 | 0.19 | 0.10 | Balance |

FIG. 2A

| Embodiments | Graphite micro powder / % | Nickel powder / % | Added forming agent/ % | Oxygen in brass powder/ % | Copper oxide powder % | Brass powder / % |
|---|---|---|---|---|---|---|
| 23 | 0.07 | 0.11 | 1.2 | 0.20 | 0.05 | Balance |
| 24 | 0.5 | 0.60 | 0.9 | 0.46 | 2.20 | Balance |
| 25 | 0.15 | 0.14 | 1.2 | 0.18 | 0.50 | Balance |
| 26 | 0.10 | 0.13 | 1.2 | 0.19 | 0.10 | Balance |
| 27 | 0.30 | 0.40 | 0.8 | 0.22 | 0.25 | Balance |
| 28 | 2.0 | 1.5 | 1.2 | 0.45 | 6.65 | Balance |
| 29 | 0.06 | 0.10 | 1.0 | 0.46 | 4.40 | Balance |
| 30 | 1.0 | 1.0 | 1.2 | 0.44 | 2.25 | Balance |
| 31 | 1.5 | 1.3 | 1.1 | 0.46 | 4.40 | Balance |
| 32 | 1.5 | 1.3 | 1.2 | 0.45 | 6.65 | Balance |
| 33 | 0.20 | 0.3 | 0.5(Zinc Stearate) | 0.22 | 1.15? | Balance |

FIG. 2B

| Embodiments | Mixing time/h | Sintering temperature /℃ | Heating time/h | Heat preservation time /min | Sintering atmosphere | Re-sintering temperature /℃ | Heating time/h | Heat preservation time/min | Re-Sintering atmosphere | Re-pressing pressure /MPa | Cold-forge pressure/ MPa | Hot extrusion temperature |
|---|---|---|---|---|---|---|---|---|---|---|---|---|
| 1 | 4 | 680 | 5 | 180 | Inert | 820 | 3 | 120 | Inert | 500 | - | 800 |
| 2 | 2 | 680 | 3 | 180 | Inert | 840 | 2 | 105 | Inert | 600 | - | 700 |
| 3 | 4 | 680 | 5 | 180 | Reducing | 860 | 2 | 60 | Reducing | 800 | - | 820 |
| 4 | 2 | 680 | 5 | 180 | Reducing | 870 | 1 | 30 | Reducing | 700 | - | 830 |
| 5 | 4 | 680 | 2 | 180 | Reducing | 860 | 2 | 90 | Reducing | 700 | - | 720 |
| 6 | 3 | 680 | 3 | 180 | Reducing | 860 | 2 | 90 | Reducing | 700 | - | 730 |
| 7 | 4 | 680 | 2 | 180 | Reducing | 860 | 2 | 90 | Reducing | 700 | - | 840 |
| 8 | 2 | 680 | 2 | 180 | Reducing | 860 | 2 | 90 | Reducing | 700 | - | 840 |
| 9 | 3 | 730 | 2 | 150 | Reducing | 860 | 2 | 90 | Reducing | 700 | - | 830 |
| 10 | 1 | 730 | 2 | 150 | Reducing | 860 | 2 | 90 | Reducing | 700 | - | 830 |
| 11 | 2 | 730 | 2 | 150 | Reducing | 860 | 2 | 90 | Reducing | 700 | - | 830 |
| 12 | 1 | 730 | 2 | 150 | Reducing | 860 | 2 | 90 | Reducing | 700 | - | 830 |
| 13 | 2 | 780 | 1 | 60 | Reducing | 860 | 2 | 90 | Reducing | 700 | - | 830 |
| 14 | 2 | 780 | 2 | 60 | Reducing | 860 | 2 | 90 | Reducing | 700 | - | 830 |
| 15 | 3 | 780 | 2 | 60 | Reducing | 860 | 2 | 90 | Reducing | 700 | - | 830 |
| 16 | 2 | 780 | 2 | 60 | Reducing | 860 | 2 | 90 | Reducing | - | 200 | 830 |
| 17 | 4 | 680 | 5 | 180 | Reducing | 860 | 2 | 90 | Reducing | - | 300 | 680 |
| 18 | 2 | 680 | 3 | 180 | Reducing | 860 | 2 | 90 | Reducing | - | 400 | 830 |
| 19 | 4 | 680 | 5 | 180 | Reducing | 860 | 2 | 90 | Reducing | - | 300 | 830 |
| 20 | 2 | 680 | 5 | 180 | Reducing | 860 | 2 | 90 | Reducing | - | 300 | 830 |

FIG 3A

| Embodiments | Mixing time/h | Sintering temperature /℃ | Heating time/h | Heat preservation time /min | Sintering atmosphere | Re-sintering temperature /℃ | Heating time/h | Heat preservation time/min | Re-Sintering atmosphere | Re-pressing pressure /MPa | Cold-forge pressure/ MPa | Hot extrusion temperature |
|---|---|---|---|---|---|---|---|---|---|---|---|---|
| 21 | 4 | 680 | 1 | 180 | Reducing | 860 | 2 | 90 | Reducing | - | 300 | 830 |
| 22 | 3 | 680 | 3 | 180 | Reducing | 860 | 2 | 90 | Reducing | - | 300 | 830 |
| 23 | 4 | 680 | 2 | 180 | Reducing | 860 | 2 | 90 | Reducing | - | 300 | 860 |
| 24 | 2 | 680 | 2 | 180 | Reducing | 860 | 2 | 90 | Reducing | - | 300 | 860 |
| 25 | 3 | 680 | 2 | 180 | Reducing | 860 | 2 | 90 | Reducing | - | 300 | 830 |
| 26 | 1 | 680 | 4 | 150 | Reducing | 860 | 2 | 90 | Reducing | - | 300 | 830 |
| 27 | 2 | 680 | 2 | 150 | Reducing | 860 | 2 | 90 | Reducing | - | 300 | 700 |
| 28 | 1 | 680 | 4 | 150 | Reducing | 860 | 2 | 90 | Reducing | - | 300 | 870 |
| 29 | 2 | 680 | 2 | 150 | Reducing | 860 | 2 | 90 | Reducing | - | 300 | 870 |
| 30 | 2 | 680 | 2 | 150 | Reducing | 860 | 2 | 90 | Reducing | - | 300 | 870 |
| 31 | 3 | 680 | 2 | 150 | Reducing | 860 | 2 | 90 | Reducing | - | 300 | 870 |
| 32 | 2 | 680 | 2 | 150 | Reducing | 860 | 2 | 90 | Reducing | - | 300 | 870 |
| 33 | 2 | 780 | 3 | 150 | Reducing | 870 | 2 | 90 | Reducing | - | 400 | 700 |

FIG. 3B

| Embodiments | Extrusion ratio | Equivalent to cutting performance of lead-brass / % | Tensile strength /MPa | Yield strength /MPa | Average thickness of dezincification layer/μm | Maximum thickness of dezincification layer /μm | Time without cracks after exposed in fumes of ammonia/h |
|---|---|---|---|---|---|---|---|
| 1 | 125 | 95 | **605.0** | **272.9** | **183.1** | **301.7** | 16 |
| 2 | 125 | 97 | **621.9** | **281.7** | **167.3** | **287.9** | 16 |
| 3 | 125 | 95 | **602.4** | **271.0** | **185.4** | **304.0** | 16 |
| 4 | 120 | 95 | **597.2** | **270.8** | **187.4** | **305.1** | 16 |
| 5 | 125 | 98 | **624.4** | **290.2** | **162.5** | **288.5** | 16 |
| 6 | 125 | 96 | **615.6** | **280.5** | **173.2** | **297.1** | 16 |
| 7 | 120 | 92 | **584.1** | **268.9** | **198.4** | **319.6** | 8 |
| 8 | 120 | 92 | **581.8** | **269.2** | **200.8** | **226.3** | 8 |
| 9 | 125 | 95 | **606.9** | **278.3** | **181.6** | **301.2** | 16 |
| 10 | 125 | 96 | **612.5** | **279.0** | **174.1** | **291.7** | 16 |
| 11 | 125 | 95 | **608.1** | **292.0** | **178.2** | **299.2** | 16 |
| 12 | 125 | 95 | **605.8** | **288.9** | **182.1** | **302.1** | 16 |
| 13 | 120 | 95 | **599.7** | **273.2** | **186.0** | **299.6** | 16 |
| 14 | 120 | 94 | **594.6** | **269.3** | **187.8** | **308.5** | 16 |
| 15 | 120 | 93 | **592.1** | **270.1** | **190.3** | **311.0** | 8 |
| 16 | 120 | 92 | **586.2** | **269.8** | **196.3** | **317.8** | 8 |
| 17 | 125 | 99 | **630.5** | **302.9** | **149.6** | **266.3** | 16 |

FIG. 4A

| Embodiments | Extrusion ratio | Equivalent to cutting performance of lead-brass / % | Tensile strength /MPa | Yield strength /MPa | Average thickness of dezincification layer/μm | Maximum thickness of dezincification layer /μm | Time without cracks after exposed in fumes of ammonia/h |
|---|---|---|---|---|---|---|---|
| 18 | 120 | 92 | **589.8** | **270.7** | **194.4** | **317.6** | 16 |
| 19 | 125 | 96 | **613.3** | **280.4** | **173.8** | **298.9** | 16 |
| 20 | 120 | 92 | **580.3** | **266.2** | **202.1** | **338.4** | 8 |
| 21 | 120 | 93 | **594.0** | **268.1** | **190.2** | **311.8** | 16 |
| 22 | 125 | 96 | **617.1** | **309.8** | **171.5** | **295.1** | 8 |
| 23 | 120 | 92 | **587.6** | **270.3** | **195.0** | **344.4** | 16 |
| 24 | 115 | 91 | **578.3** | **272.7** | **202.1** | **239.5** | 16 |
| 25 | 125 | 96 | **620.3** | **313.4** | **171.2** | **293.2** | 16 |
| 26 | 125 | 95 | **607.3** | **308.0** | **181.0** | **315.3** | 16 |
| 27 | 125 | 98 | **627.8** | **323.5** | **159.8** | **276.1** | 10 |
| 28 | 115 | 90 | **570.5** | **265.7** | **237.9** | **359.5** | 16 |
| 29 | 115 | 91 | **574.7** | **266.1** | **207.0** | **325.8** | 12 |
| 30 | 115 | 91 | **577.9** | **268.5** | **202.4** | **259.0** | 16 |
| 31 | 115 | 91 | **572.4** | **271.9** | **207.9** | **339.9** | 16 |
| 32 | 115 | 91 | **576.0** | **270.0** | **203.7** | **322.4** | 16 |
| 33 | 125 | 100 | **633.9** | **339.9** | **147.1** | **170.1** | 16 |

FIG. 4B

| Contrast brass | Equivalent to cutting performance of the lead-brass/ % | Tensile strength /MPa | Yield strength /MPa | Average thickness of dezincification layer /μm | Maximum thickness of dezincification layer /μm | Time that no crack is generated by ammonia fume /h |
|---|---|---|---|---|---|---|
| HPb59-1 | 100 | 462.3 | 161.0 | 309.2 | 482.6 | 5 |
| Cu-36 %Zn-1.0 %Mn-0.7 %Fe-0.7 %Al | 38 | 498.9 | 199.2 | 257.5 | 435.5 | 7 |
| Cu-36 %Zn-1.0 %Mn-0.7 %Fe-0.7 % Al+1 %C+1 %$Al_2O_3$(canned extruding) | 81 | 501.3 | 210.1 | 286.5 | 452.3 | 6 |

Fig. 5

OXIDE DISPERSION-STRENGTHENED ALLOY (ODS), LEAD-FREE AND FREE-CUTTING BRASS AND PRODUCING METHOD THEREOF

CROSS REFERENCE TO RELATED APPLICATIONS

This application is a 371 National Stage of PCT/CN2015/096925 filed Dec. 10, 2015. The entire contents of this application is hereby incorporated herein by reference.

FIELD OF THE INVENTION

The present invention relates to a metal material and a producing method thereof, and in particular to lead-free and free-cutting brass and a producing method thereof.

BACKGROUND OF THE INVENTION

Lead-brass has the characteristics of excellent hot and cold workability, excellent cutting performance, self-lubrication and the like, can meet the machining requirements of parts and components of various shapes. The lead-brass was once recognized as an important basic metal material and has been widely used in the fields of civil water supply systems, electronics, automobiles, and machinery producing. As the lead-brass is widely used, there are many discarded spare and accessory parts of lead-brass, of which only a small amount is recycled and many small pieces are abandoned as garbage. The disused lead-brass comes into contact with the soil, and the lead contained in it enters the soil under the long-term effect of rain and atmosphere, thus contaminating the soil and water sources. When the disused lead-brass is burned as garbage, lead vapor is emitted into the atmosphere, causing great harm to the human body, and thus its application is increasingly subject to strict restrictions. Lead neither dissolves in copper nor forms an intermetallic compound with copper, but exists in grain boundaries in the form of simple substance microparticles, and sometimes in grains. The lead in lead-brass precipitates slowly in the form of ions under the action of impurities, ions and the like in drinking water. The existing lead-brass can hardly meet the requirements of environmental protection laws. In order to reduce the harmful effects of the lead, researchers have systematically studied the corrosive effects of the drinking water on brass and the corrosive effects of additive elements on the brass, and have taken various measures. For example, a small amount of tin, nickel or other alloy element is added in the lead-brass to improve the corrosion resistance of the lead-brass, or a certain thickness of soluble lead is dissolved to be removed and then the surface where the lead is removed is covered with chromium or other corrosion-resistant metal, or other method is adopted to inhibit the leaching of the lead, and so on. Since the lead is always present in the brass substrate, these methods cannot fundamentally eliminate the harmful effects of the lead. The lead-brass, which uses lead as a main element to improve the cutting performance of brass, has to gradually withdraw from the historical stage under the environmental protection ordinance.

Either in view of the environmental protection laws and regulations in China and abroad, or from a technical and economic point of view, the improvement of repairing the lead-brass has no great value, and only the development of novel lead-free and free-cutting brass is a wayout. People have a long-term accumulation of researches on metals, alloys and compounds, and their understanding of the characteristics thereof has been abundant. It has been recognized that the addition of bismuth, antimony, magnesium, phosphorus, silicon, sulfur, calcium, tellurium, selenium and other elements to the brass can improve its cutting performance, and there are a large number of patents published in China and abroad in this respect. It must be pointed out that compared with the free-cutting lead-brass, all the lead-free and free-cutting brass currently has some problems in the processing performance, use performance and cost, for example, hot and cold processing performance, cutting processing performance and other process performance or dezincification resistance, ammonia fume resistance and other use performance, and its overall performance and the performance price ratio are still much inferior to those of lead-brass.

When the metal bismuth is used as the main element to improve the cutting performance of the brass, the brass with a high content of bismuth cannot be accepted in the market due to the high price of bismuth. The cutting performance of the brass with low content of bismuth is also relatively good, but is still much worse than that of the lead-brass. On the other hand, the influence of bismuth ions on human health is still not very clear, and the magnitude of its side effects has not yet been determined. In some countries and regions, people are still unwilling to accept bismuth brass. Bismuth with limited resources is also doomed not to become a major alternative to the lead in the free-cutting lead-brass. Bismuth can cause the brass to be brittle, which seriously deteriorates the hot workability of the brass. Its recycled material can even harm the entire copper processing industry, which seriously reduces its recycling value, and is unfavorable to the market promotion of the bismuth-containing and free-cutting brass.

Antimony is an element that is slightly toxic to the human body and its leaching concentration in water is very strictly limited. Although the antimony brass has better cutting performance, its use is also very limited. The hot workability of the antimony brass is also not ideal, and it is prone to thermal cracking; and the price of antimony is not cheap, which is also unfavorable for its market promotion.

Magnesium can significantly improve the cutting performance of the brass, but it cannot be added too much, when its mass fraction exceeds 0.2%, the elongation of the brass begins to decline, and the more the magnesium is added, the more the elongation performance of the brass declines, which is unfavorable for the use of the brass and not conducive to the application of magnesium brass. Magnesium is an element that burns very easily, which poses a great challenge to the control of the magnesium content in the brass, and is unfavorable for the composition control in the production process.

Adding phosphorus to the brass is favorable to the improvement of cutting performance of the brass, but at the same time reduces the plasticity of the brass, so that the hot cracking tendency of the brass increases during low pressure casting. This greatly limits the amount of phosphorus added to the brass and also greatly limits the use of phosphorus brass as well.

Due to the high prices of tin, tellurium and selenium, tin brass and tellurium-containing brass and selenium-containing brass are difficult to be widely promoted in the market. Tin also has a limited effect on improving the cutting performance of the brass.

The existing silicon brass is divided into two types. One type is low-zinc silicon brass, such as C69300, and due to the high content of copper, high density and high price, its market share is small. The other type is high-zinc silicon brass, which lacks cutting performance. The melting point of sulfur is only 113° C., and its boiling point is only 445° C., it is prone to enter the surrounding environment and become a source of pollution during the production of the brass. With increasingly stringent environmental laws and regulations, the pollution control of its production is also a problem, which is also extremely unfavorable for its application and promotion. When there is no manganese in the brass, the sulfur usually exists in the grain boundary in the form of a eutectic with a low melting point in the brass, which makes the brass brittle. The pressure processing of the sulfur-based and free-cutting brass is generally difficult and relatively high in cost.

When manganese is present in the brass melt, if sulfur is added or a sulfide that have an affinity to sulphur less than the affinity of manganese to sulphur, the sulfur or the sulfide reacts with manganese to generate manganese sulfide, which floats in the form of slag in the brass melt, so that the cutting effect of the sulfur is significantly weakened until disappears.

The content of zinc in the brass is high, the zinc is a element which is easy to volatilize, the manganese sulfide generated by the manganese element and the sulfur element in the brass melt is liable to be brought to the melt surface by the high-temperature zinc bubbles, and the brass melt is usually degassed by using the eruption process before being discharged from the furnace, so that the generated manganese sulfide slag is taken in a large quantity to the melt surface and is removed as slag, which is also an important reason why the manganese and the sulfur can hardly coexist in the cast brass. It has been disclosed in the published Chinese patent for invention with the patent No. 201110035313.7 that has a good effect in the manufacture of laboratory ingots; however, as described in claim 3 of it, it is necessary to "rapidly add zinc and cast into ingot immediately after the zinc is added", in industrial large-scale production, the above conditions cannot be met, and the free-cutting effect of the manganese sulfide product rapidly decreases until disappears as the residence time of the brass melt increases. Moreover, as the content of sulfur increases, the more manganese sulfide is generated, the faster it becomes slag and floats, and the more obvious the weakening of its cutting action becomes. It can be seen from the free-cutting mechanism of manganese sulfide in the brass, under the conditions of not significantly deteriorating the process performance or the use performance of the brass, the higher the sulfur content and the more the manganese sulfide product is, the better the cutting machining performance of the alloy is. However, when manufactured by the melt casting method, the manganese sulfide is more likely to float out from the melt, and the effect of improving the cutting performance is weakened more quickly. This indicates that the high-sulfur manganese-containing brass should not be produced by melt casting.

In actual development, engineering technicians mostly use a method with diversified alloy elements and add a plurality of alloy elements having an effect of improving the cutting performance to the brass. However, the practice has shown that the method of adding a plurality of elements for improving the cutting performance is not ideal. On one hand, due to the interaction between the elements, some can reduce the effect of improving the cutting performance. On the other hand, due to the addition of the variety of metal elements, the effect of alloy strengthening can be produced, which increases the strength and the hardness of the brass, and can reduce the pressure processing and the machining performance of the brass to a certain degree. Moreover, the addition of rare and precious elements can also increase the cost of the brass quickly, which is also disadvantageous for the marketing applications. There is limitation in adding various elements to improve the process performance and the use performance of brass.

In the PCT application PCT/CN201308296 entitled "Lead-free and free-cutting high-sulfur manganese-containing copper alloy and producing method thereof", the cutting performance of a lead-free copper alloy is maximally improved by using a method of adding a sulfide, and it has the best cutting performance in the lead-free and free-cutting copper alloy that can be industrially mass-produced, but its cutting performance is still inferior to that of the lead-brass. In some conditions of use, for example, in the production of valve faucets with very complex shape, a copper rod must be subjected to very complex thermal deformation, which requires excellent thermal deformation capability, but the thermal deformability of the alloy is far from ideal, and under the large deformation condition, the finished product rate still needs to be improved, resulting in a higher production cost.

U.S. Pat. No. 5,089,354 entitled "Wear-resistant, anti-seizing copper alloy composite materials" discloses two lead-free and free-cutting copper alloys, the components of which are Cu-36% Zn-1.0% Mn-0.7% Fe-0.7% Al. Firstly, the brass disclosed in the invention contains 0.7% of Fe, and its function is to generally refine the grains and mainly form a heterogeneous core, but this heterogeneous core can reduce the dezincification resistance of the brass, the core is prone to micro-cracks under the ammonia fume condition, once the micro-cracks become unstable and expand, it will lose effect, that is, the brass's ability to resist the ammonia fume stress corrosion is reduced. Secondly, in this patent, the content of aluminum in the brass obviously exceeds the content of oxygen, which causes uneven distribution of aluminum and oxygen, the particles added are coarse and unevenly distributed, the aluminum oxide particles are micron-sized and the interface with the brass is not strong, thereby reducing the strength of the brass and more seriously, greatly reducing the thermal deformability of the brass, therefore canning must be adopted in its thermal forming. In addition, in this invention, at least 1% of graphite is added to the brass composite material, the excessive graphite not only reduces the cutting performance, but also can decrease the strength of the brass due to the low strength of the graphite/brass interface.

Technical Problem

Since a valve faucet is in direct contact with water, and there are usually various ions and micro-particles and other substances in the water, under long-term action, zinc will enter the water and cause dezincification corrosion of the brass to lose effect. Therefore, the ability of dezincification corrosion resistance is a very important indicator of the brass used for the valve faucet. On the other hand, the service environment of the valve is complex. For example, in toilets, the brass is prone to stress cracking in the ammonia in the ammonia environment for a long term, resulting in valve failure. Therefore, the ammonia fume stress corrosion resistance is another important indicator of the brass for the valve faucet. The valve is an essential product having a wide range of uses and being closely related to the daily life and industrial production, and is produced in large quantities, and is required to have very strong thermal deformation capability to meet the large-scale and high-efficiency industrial production capacity, that is, the brass for valve production must have excellent thermal deformability and a high hot extrusion ratio, and the canned extruding or canned hot forging or other thermal processing processes cannot be used. There is an urgent need in the market for a new lead-free and free-cutting brass, which has excellent processing properties such as hot forging, polishing and electroplating properties, and has cutting performance requirements being close to those of the lead-brass, and high strength as well as good dezincification resistance, ammonia fume resistance and other excellent use performance, so that it is suitable for valve faucets and other products.

Solution to the Problem

Technical Solution

The objective of the present invention is to provide oxide dispersion-strengthened alloy (ODS), lead-free and free-cutting brass and a producing method thereof. The mass percent of components in the brass are: 52.0%-90.0% of copper, 0.001%-0.99% of phosphorus, 0.15%-0.70% of tin, 0.25%-3.0% of manganese, 0.15%-0.90% of aluminum, 0.10%-1.5% of nickel, 0.191%-0.90% of oxygen and 0.06%-0.80% of carbon, and the ratio of aluminum to oxygen not exceeding 27:24, with the balance being zinc and inevitable impurities, wherein lead is not more than 0.08%.

As a preferred embodiment of the present invention, the mass percent of components in the brass are: 54.0%-80.0% of copper, 0.01%-0.79% of phosphorus, 0.15%-0.60% of tin, 0.30%-2.0% of manganese, 0.16%-0.80% of aluminum, 0.12%-1.3% of nickel, 0.20%-0.75% of oxygen, and 0.08%-0.70% of carbon, the ratio of aluminum content to oxygen content not exceeding 27:24, with the balance being zinc and inevitable impurities, wherein lead is not more than 0.07%.

Further, the mass percent of components in the brass are: 56.0%-70.0% of copper, 0.01%-0.49% of phosphorus, 0.20%-0.55% of tin, 0.35%-1.5% of manganese, 0.17%-0.70% of aluminum, 0.15%-1.0% of nickel, 0.20%-0.65% of oxygen, and 0.10%-0.60% of carbon, the ratio of aluminum to oxygen not exceeding 27:24, and the balance being zinc and inevitable impurities, wherein lead is not more than 0.06%.

Further, the mass percent of components in the brass are: 57.0%-68.0% of copper, 0.01%-0.29% of phosphorus, 0.25%-0.50% of tin, 0.40%-1.0% of manganese, 0.18%-0.60% of aluminum, 0.15%-0.6% of nickel, 0.20%-0.59% of oxygen, and 0.15%-0.50% of carbon, the ratio of aluminum to oxygen not exceeding 27:24, with the balance being zinc and inevitable impurities, wherein lead is not more than 0.06%.

Further, the mass percent of components in the brass are: 57.0%-63.0% of copper, 0.01%-0.10% of phosphorus, 0.30%-0.50% of tin, 0.50%-0.80% of manganese, 0.20%-0.50% of aluminum, 0.20%-0.50% of nickel, 0.22%-0.5% of oxygen, and 0.20%-0.30% of carbon, the ratio of aluminum to oxygen not exceeding 27:24, with the balance being zinc and inevitable impurities, wherein lead is not more than 0.05%.

The technological process of the lead-free and free-cutting brass of the present invention is as follows:

A) Cu, Sn, Mn, P, Zn and Al are melted sequentially, then distributed uniformly, then the alloy elements are made into brass powder using water or gas atomization;

B) nickel powder, brass powder, copper oxide powder are mixed with graphite micro powder with a particle size of less than 10 μm, then the forming agent is added by 0.001%-1.5% to above mixture and is mixed for 0.4-5 h to make the powders uniformly distributed;

C) the uniformly mixed powders are molded by compression, then sintered with the following sintering process: the said mixed powders are heated from room temperature to the sintering temperature of 680-780° C. with heating time of 1-5 h and heat preservation time of 30-180 minutes, the forming agent is removed, where the sintering atmosphere is a reducing atmosphere or an inert atmosphere;

D) the sintered brass obtained by above step is treated by cold re-press at 500-800 MPa, or by cold-forge on the punching machine with a fast-moving punch at 200-400 MPa, and then re-sintered with the following resintering process: the alloy are heated from room temperature to the sintering temperature of 820-870° C. with heating time of 1-3 h and heat preservation time of 30-180 minutes, where the re-sintering atmosphere is a reducing atmosphere or an inert atmosphere; and E) the re-sintered brass is thermally treated at the temperature of 680-870° C.

The forming agent is paraffin powder or stearate powder.

The stearate powder is zinc stearate powder, lithium stearate powder, sodium stearate powder, magnesium stearate powder, aluminum stearate powder, potassium stearate powder or calcium stearate powder.

The step E) is conducted by hot die forging, hot extrusion or hot-rolling.

Beneficial Effects of the Invention

Beneficial Effects

In the present invention, a small amount of aluminum is added to the brass, and the ratio of aluminum to oxygen does not exceed 27:24, so that aluminum reacts with oxygen contained in the copper oxide or the oxygen contained in the brass powder in situ during the sintering process to generate aluminum oxide. Since the aluminum in the brass powder is solid dissolved in the copper, the high-pressure water has very strong cooling ability. The aluminum which is solid dissolved in the brass melt at the high temperature is fixed in the solid state before it can be segregated. The product generated by the reaction of the aluminum in the atom state with the oxygen is nanoscale and forms an approximately coherent lattice interface structure with the brass, so that the interface strength is very high. The in-situ generated aluminum oxide has very uniform and dispersive distribution, which absolutely cannot be achieved by the addition of micron-sized aluminum oxide powder. It is an excellent reinforced phase and high-temperature resistant phase, which significantly increases the room temperature strength and the high-temperature strength of the brass. The traditional view of powder metallurgy is that the lower the content of oxygen in the brass, the better. In the present invention, the content of oxygen is strictly controlled, and the ratio of aluminum to oxygen does not exceed 27:24 so as to ensure that the oxygen in the alloy basically reacts with the aluminum in situ to generate the aluminum oxide, and meanwhile ensures the dispersive distribution thereof. In this way, it can only be guaranteed that the oxygen has strengthening effect on the brass, rather than other negative effects.

Graphite is a good soft cutting phase to improve the cutting performance, but its intermiscibility with the brass is poor, the strength of the graphite/brass interface is low, so the addition of graphite will destroy the overall structure of the brass, and reduce the strength and the thermal deformability of the brass. A certain amount of graphite can improve the cutting performance of the brass, but adding too much graphite can instead reduce the finish of the cutting surface of the brass, thereby reducing the cutting performance of the brass. In the present invention, in order to minimize the adverse effects of the graphite on the strength and the thermal deformability, some special measures are adopted, for example, the added graphite micro powder is firstly subjected to purification treatment, and then is subjected to activation treatment, and then the surface is plated with nickel. Nickel and copper form an infinitely mutually soluble solid solution, the nickel plated on the surface and the brass form a high-strength interdiffusion layer, which is a high-strength metallurgical bond. In this way, the graphite/brass interface is clean and the bonding strength is high, which can ensure the high strength and high thermal deformability of the brass. The particle size range of the selected graphite is optimized to ensure that the particle diameter does not exceed 10 μm. The microstructure of the sintered brass after heat deformation treatment is finer and more uniform than that of the sintered state, the distribution of the aluminum oxide hard phase and the graphite soft phase is more dispersive and uniform, and the interface bonding is good. The above measures fully ensure the cutting ability, high hardness, high strength and high thermal deformability of the brass.

It is generally believed that the effect of phosphorus is deoxidation, which can improve the casting and welding performance of the alloy, reduce the loss of oxidation of the beneficial elements silicon, tin and magnesium and refine the grains of the brass. In the alloy of the present invention, the adding amount of phosphorus is controlled within the range of 0.001%-0.99%, and the function of phosphorus is to lower the melting point of the brass powder during the sintering process, to have a certain effect of activated sintering and to have certain benefits in increasing the strength of the brass. Both tin and nickel strongly enhance the ability of dezincification corrosion resistance and ammonia fume stress corrosion resistance of brass. Such brass can meet the requirements of the valve industry for dezincification corrosion resistance and the ammonia fume stress corrosion resistance of the brass.

The oxide dispersion-strengthened alloy (ODS), lead-free and free-cutting brass of the present invention has excellent process performance such as excellent cutting processing performance, hot forging performance and the like, and excellent use performance such as high strength, hardness, dezincification resistance, ammonia fume resistance, polishing, electroplating, self-lubricating performance and wear resistance. The brass subjected to re-pressing and re-sintering has good thermal processing performance such as hot forging, hot extrusion and hot rolling. The brass subjected to hot extrusion has good cutting performance and high strength. According to the ISO 6509: 1981 "Corrosion of metals and alloys—Determination of dezincification resistance of brass", the brass subjected to hot extrusion has excellent dezincification resistance, according to the GB/T 10567.2-2007 "Wrought copper and copper alloys-Detection of residual stress-Ammonia test", but when the concentration of ammonia is 14%, the longest time of ammonia fume resistance of the brass without generating cracks is 16 hours, and its highest cutting performance is equivalent to 100% of HPb59-1.

The brass processing method of the present invention can adopt direct thermoforming without canning and can be applied to the production of valve faucets. However, the conventional lead-free brass produced by the canned thermoforming cannot be applied to the production of valve faucets. Furthermore, the brass of the present invention does not contain lead, cadmium, mercury, arsenic and other harmful elements, the production process is free of pollution, and elements such as chromium, bismuth, antimony and the like are not contained, and the stringent requirements for the leaching of harmful elements in the plumbing and bathroom industry can be completely satisfied.

BRIEF DESCRIPTION OF THE DRAWINGS

FIG. 1 shows a chemical component list (weight percentage content) of brass powder prepared in embodiments 1-33;

FIGS. 2A and 2B show a list of weight percentage content of various powder in embodiments 1-33, wherein the amount of copper oxide powder is actual needed amount after oxygen contained in the brass powder is subtracted;

FIGS. 3A and 3B show a producing process parameter list of brass in embodiments 1-33, wherein "-" indicates that the process is not executed;

FIGS. 4A and 4B are performance lists of the brass in embodiments 1-33;

FIG. 5 shows an ingredient and performance list of brass in a contrast example.

EMBODIMENTS OF THE INVENTION

Detailed Description of the Embodiments

The mass fractions of elements in the brass powder are as follows: 56.0% of copper, 0.11% of phosphorus, 0.20% of tin, 0.50% of manganese, 0.19% of aluminum, and the balance of zinc and unavoidable impurities. The mass fractions of various powder are as follows: the content of graphite micro powder is 0.10%; the content of nickel powder is 0.13%; the content of externally added lithium stearate is 0.5%; the content of oxygen in the brass powder is 0.18%; the content of copper oxide powder is 0.10%; and the balance is the above brass powder. The mixing time of powders is 4.0 h, compressing is performed after the mixing is accomplished, and sintering is performed in a sintering furnace after compressing, wherein the sintering process is as follows: the mixed powders are heated from the room temperature to the sintering temperature of 680° C. for 5.0 h, then held at the temperature for 180 min, the forming agent is removed, the sintering atmosphere being an inert atmosphere, and cooling to the room temperature by water after the sintering is accomplished. The sintered brass rod is re-pressed at a pressure of 500 MPa, and then is re-sintered, wherein the re-sintering process is as follows: the alloy are heated from the room temperature to a sintering temperature of 820° C. for 3.0 h, then held at the temperature for 120 min, the sintering atmosphere being the inert atmosphere. The re-sintered brass is hot extruded at 800° C. The extruded rod is sampled to prepare a tensile strength sample, a cutting performance sample, a dezincification corrosion resistance sample and an ammonia fume stress corrosion sample. The experimental results show that the cutting ability is equivalent to 95% of the lead-brass. The tensile strength is 605.0 MPa, the yield strength is 272.9 MPa, and the average thickness of dezincification layer is 183.1 um, the maximum thickness of dezincification layer is 301.7 μm, and no crack is generated after ammonia fume for 16 hours.

Embodiment 2-Embodiment 33

The chemical component (mass percent content) list of the brass powder prepared in embodiments 1-33 is shown in FIG. 1, and the mass percent content list of various powder added in the preparation process of the brass in the embodiments 1-33 is shown in FIGS. 2A and 2B. In all of the embodiments, the forming agent is paraffin powder unless otherwise specified.

The producing process parameter list of the brass in the embodiments 1-33 is shown in figures.

After the completion of the embodiments, the hot extruded rod is sampled to prepare a tensile strength sample, a cutting performance sample, a dezincification corrosion resistance sample and an ammonia fume stress corrosion sample. A hardness test sample and a friction and wear sample are taken from the hot extruded copper-tin alloy-based brass rod, and then hardness tests and friction and wear tests are respectively performed to obtain the performance of the alloy. The performance list of the brass in the embodiments 1-33 is shown in FIGS. 4A and 4B.

A component and performance list of brass in a contrast example is shown in FIG. 5.

The invention claimed is:

1. Oxide dispersion-strengthened alloy (ODS) and free-cutting brass, wherein the mass percent of components in the brass are: 52.0%-90.0% of copper, 0.001%-0.99% of phosphorus, 0.15%-0.70% of tin, 0.25%-3.0% of manganese, 0.15%-0.90% of aluminum, 0.10%-1.5% of nickel, 0.191%-0.90% of oxygen and 0.06%-0.80% of carbon, and the ratio of aluminum to oxygen not exceeding 27:24, with the balance being zinc and inevitable impurities, wherein lead is not more than 0.08%.

2. The oxide dispersion-strengthened alloy (ODS) and free-cutting brass of claim 1, wherein the mass percent of components in the brass are: 54.0%-80.0% of copper, 0.01%-0.79% of phosphorus, 0.15%-0.60% of tin, 0.30%-2.0% of manganese, 0.16%-0.80% of aluminum, 0.12%-1.3% of nickel, 0.20%-0.75% of oxygen, and 0.08%-0.70% of carbon, the ratio of aluminum to oxygen not exceeding 27:24, with the balance being zinc and inevitable impurities, wherein lead is not more than 0.07%.

3. The oxide dispersion-strengthened alloy (ODS) and free-cutting brass of claim 2, wherein the mass percent of components in the brass are: 56.0%-70.0% of copper, 0.01%-0.49% of phosphorus, 0.20%-0.55% of tin, 0.35%-1.5% of manganese, 0.17%-0.70% of aluminum, 0.15%-1.0% of nickel, 0.20%-0.65% of oxygen, and 0.10%-0.60% of carbon, the ratio of aluminum to oxygen not exceeding 27:24, with the balance being zinc and inevitable impurities, wherein lead is not more than 0.06%.

4. The oxide dispersion-strengthened alloy (ODS) and free-cutting brass of claim 3, wherein the mass percent of components in the brass are: 57.0%-68.0% of copper, 0.01%-0.29% of phosphorus, 0.25%-0.50% of tin, 0.40%-1.0% of manganese, 0.18%-0.60% of aluminum, 0.15%-0.6% of nickel, 0.20%-0.59% of oxygen, and 0.15%-0.50% of carbon, the ratio of aluminum to oxygen not exceeding 27:24, with the balance being zinc and inevitable impurities, wherein lead is not more than 0.06%.

5. The oxide dispersion-strengthened alloy (ODS) and free-cutting brass of claim 4, wherein the mass percent of components in the brass are: 57.0%-63.0% of copper, 0.01%-0.10% of phosphorus, 0.30%-0.50% of tin, 0.50%-0.80% of manganese, 0.20%-0.50% of aluminum, 0.20%-0.50% of nickel, 0.22%-0.50% of oxygen, and 0.20%-0.30% of carbon, the ratio of aluminum to oxygen not exceeding 27:24, with the balance being zinc and inevitable impurities, wherein lead is not more than 0.05%.

6. A producing method of the oxide dispersion-strengthened alloy (ODS) and free-cutting brass of claim 1, comprising:

A) Cu, Sn, Mn, P, Zn and Al are melted sequentially, then distributed uniformly, then the alloy elements are made into brass powder using water or gas atomization;

B) nickel powder, brass powder, copper oxide powder are mixed with graphite micro powder with a particle size of less than 10 μm, then the forming agent is added by 0.001%-1.5% to above mixture and is mixed for 0.4-5 h to make the powders uniformly distributed;

C) the uniformly mixed powders are molded by compression, then sintered with the following sintering process: the said mixed powders are heated from room temperature to the sintering temperature of 680-780° C. with heating time of 1-5 h and heat preservation time of 30-180 minutes, the forming agent is removed, where the sintering atmosphere is a reducing atmosphere or an inert atmosphere;

D) the sintered brass obtained by above step is treated by cold re-press at 500-800 MPa, or by cold-forge at 200-400 MPa, and then re-sintered with the following resintering process: the alloy are heated from room temperature to the re-sintering temperature of 820-870° C. with heating time of 1-3 h and heat preservation time of 30-180 minutes, where the sintering atmosphere is a reducing atmosphere or an inert atmosphere;

E) the re-sintered brass is thermally treated at the temperature of 680-870° C.

7. The producing method of claim 6, wherein the forming agent is paraffin powder or stearate powder; and the stearate powder is one of zinc stearate powder, lithium stearate powder, sodium stearate powder, magnesium stearate powder, aluminum stearate powder, potassium stearate powder and calcium stearate powder.

8. The producing method of claim 6, wherein the step E) is conducted by hot die forging, hot extrusion or hot-rolling.

* * * * *